United States Patent [19]

Candida

[11] 3,979,747

[45] Sept. 7, 1976

[54] CONTROL CIRCUIT FOR A CHARACTER SEGMENT DISPLAY ASSEMBLY

[75] Inventor: Domenic Candida, Massapequa, N.Y.

[73] Assignee: Vernitron Corporation, Great Neck, N.Y.

[22] Filed: June 2, 1975

[21] Appl. No.: 583,026

[52] U.S. Cl. ..... 340/373; 340/319

[51] Int. Cl.[2] ..... G08B 5/00

[58] Field of Search ..... 340/373, 319

[56] References Cited

UNITED STATES PATENTS 3,573,811 4/1971 Knecht ..... 340/373

*Primary Examiner*—Thomas B. Habecker

[57] ABSTRACT

A seven character segment display assembly with each assembly including a rotatable drum carrying a character display adapted to be viewed at a window of a stationary mask. The drum includes a permanent magnet which is adapted to be attracted by the poles of a stationary wire coil wound as a bifilar center tapped winding on a core. The control circuit provides a D. C. voltage to the center tap of the coil. The circuit includes first and second invertors having outputs connected to the opposite ends of the coil. The output of the first invertor is connected to the input of the second invertor. A decoder generating logic signal pulses has an output connected to the input of the first invertor.

7 Claims, 6 Drawing Figures

CONTROL CIRCUIT FOR A CHARACTER SEGMENT DISPLAY ASSEMBLY

This invention relates to the art of a segment display character assembly and more particularly, concerns a control circuit for a segment character display assembly.

A character segment display assembly generally comprises seven segment display units each having a rotatable drum which carries a character display flag adjacent the window of a mask having seven windows. Each drum also carries a magnetic member adapted to be attracted to a pole of an energizable coil thereby rotating the drum so that the display flag is positioned in and out of alignment with its respective window. The control circuit for this type of display generally requires a reset mode to permit the flags which were displayed to be rotated out of alignment with the window and into alignment with the flags which were not displayed, before a new display could be activated.

In the present invention, the coils are connected to a novel control circuit which provides a signal to cause the drum carrying the character display to rotate to either one of two positions designated SET and RESET respectively. In the SET position, the drum is rotated in one direction to expose the character display flag at the adjacent window. In the RESET position, the drum is rotated in the opposite direction to cause the character display flag to be rotated away from the window. The control circuit is energized by a decoder circuit which provides SET and RESET signals to energize all seven control circuits at the same time so that a composite character defined by selected exposed flags appears at the mask depending on which of the display units are in the SET mode. The other display units of the assembly will be simultaneously placed in the RESET mode and will display no flags.

According to the invention, each control circuit includes a pair of voltage invertors having outputs connected to opposite ends of a bifilar coil or winding having a common center tap connected to a constant positive voltage source. One signal output line of a decoder is connected to the input of one invertor. The output of this invertor is connected to the input of the other invertor. The coil is mounted on a core which carries two magnetic poles extending radially outward of the coil at opposite ends of the core. The poles assume opposite polarities N or S depending on whether SET or RESET signals are applied to the coil. The polarities of the poles will determine the direction in which the associated drum carrying permanent magnets and a flag will rotate.

It is, therefore, a principal object of the present invention to provide a segmental display unit with a control circuit operated in SET and RESET modes for selectively exposing and retracting a display flag at a window of a mask.

A further object of the present invention is to provide a segmental display unit with a control circuit including voltage invertors connected to opposite terminals of a coil and arranged so that one invertor drives the other.

Another object of the present invention is to provide a segmental display unit as described, wherein the coil has two magnetic poles which are oppositely polarized and each assumes N or S polarity depending on the magnitude of control signal applied to the one invertor driving the other invertor.

These and other objects and many of the attendant advantages of this invention will be readily appreciated as the same becomes better understood by reference to the following detailed description when considered in connection with the accompanying drawings in which.

Figure 1:
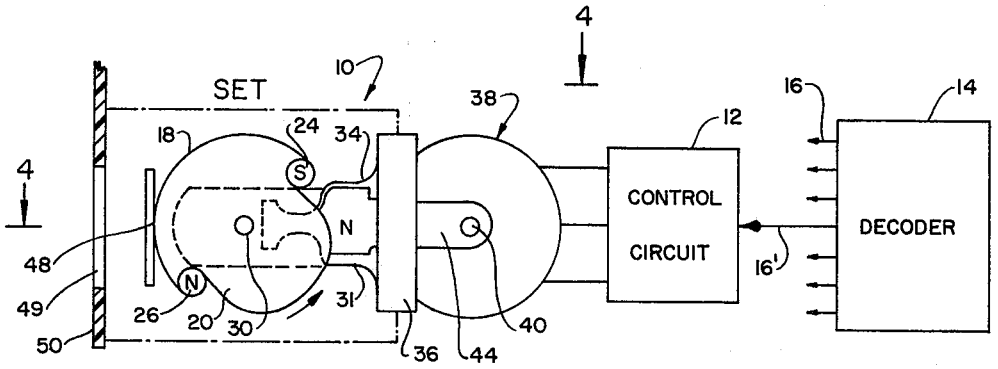
FIG. 1 is a side view partially in section and partially diagrammatic showing a segmental display assembly according to the invention, with display unit in SET position.

Referring now to the drawings wherein like reference characters designate like or corresponding parts throughout, there is illustrated in FIG. 1 a segmental display assembly including a segmental display unit generally designated as reference numeral 10 connected to a control circuit 12 which is actuated by a logic decoder 14. The decoder has seven output lines 16 of which one line 16' is connected to the control circuit 12. The other six lines 16 are connected respectively to six other similar control circuits 12 (not shown) connected respectively to six other display units 10 (not shown) each identical to unit 10.

Figure 4:
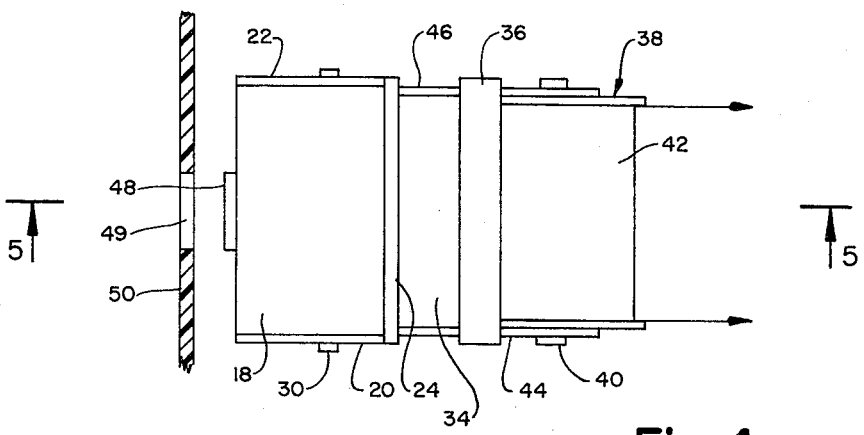
FIG. 4 is a top plan view of the segmental display unit per se taken along line 4—4 of FIG. 1.
Figure 5:
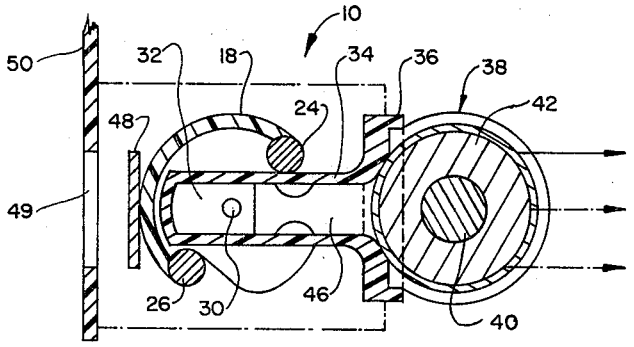
FIG. 5 is a vertical sectional view taken along line 5—5 of FIG. 4.

Referring now to FIGS. 1, 4 and 5, each display unit 10 includes a semicylindrical drum 18 having flat end plates 20, 22. The drum 18 is made of nonmagnetic material such as acrylic or other suitable plastic. At diametrically opposed ends of the drum 18 are two permanent magnet bars 24, 26 oppositely polarized, that is, the N pole of the bar 24 and the S pole of the bar 26 are located at the end plate 22, while the S pole of the bar 24 and the N pole of the bar 26 are located at the end plate 20. The drum 18 is rotatably supported by a pin 30 set in end plates 20, 22 and engage opposite walls 31, 32 of a generally U-shaped plastic frame 34. A base 36 of the frame 34 is secured to a coil assembly 38 which has a magnetic core 40 on which is wound a wire coil 42. A pair of magnetic pole pieces 44, 46 are secured to opposite ends of the core 40 and extend radially outward of the core 40. The pole pieces 44 and 46 are engaged in the frame 34 and are flat members which are disposed near the rotatable magnet bars 24, 26. When the coil 42 is energized by the control circuit 12, the pole pieces 44 and 46 become oppositely magnetized and attract or repel the magnet bars 24, 26 to cause the drum 18 to rotate in one direction or the other.

Figure 6:
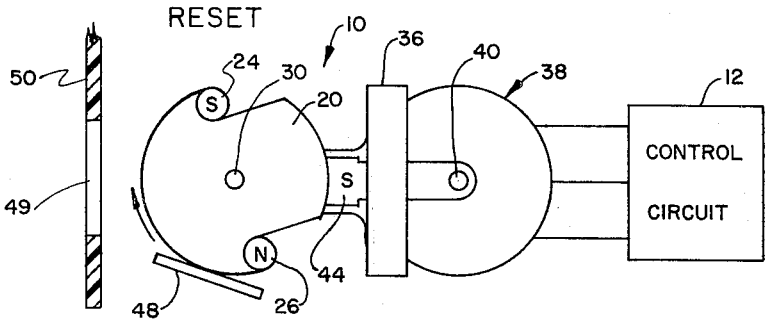
FIG. 6 is a side view similar to FIG. 1 showing the segmental display unit in RESET position.

The drum carries a display flag 48 disposed near an open window 49 of a mask 50. In one position of the drum 18 shown in FIGS. 1, 4 and 5, the flag 48 is exposed at the window 49. In another position of the drum 18 shown in FIG. 6, the flag 48 is turned away from the window 49. The drum 18 has only two stable positions each maintained by appropriate control signals applied by the control circuit 12 to the coil 42.

Figure 2:
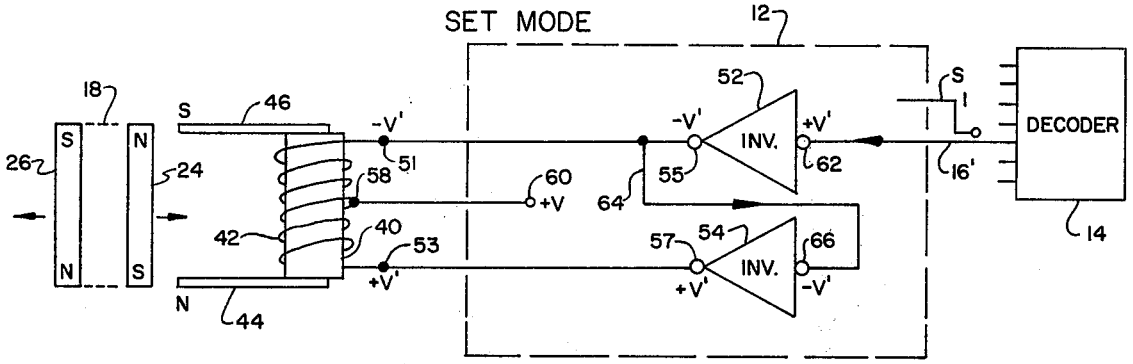
FIG. 2 is a diagram of the control circuit and associated components, arranged in the SET mode of operation.
Figure 3:
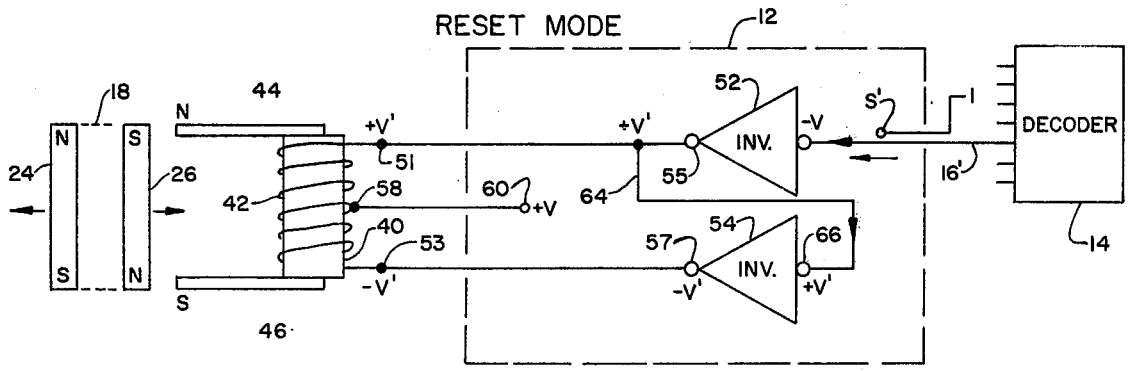
FIG. 3 is a diagram similar to FIG. 2, shown arranged in the RESET mode of operation.

Referring now to FIGS. 2 and 3, it will be noted that the control circuit 12 may be operated in SET and RESET modes. In the control circuit 12 are two voltage invertors 52, 54. An output terminal 55 of the invertor 52 is connected to one end 51 of the coil 42. An output terminal 57 of the invertor 54 is connected to the other end 53 of the coil 42. The coil 42 is wound on the core 40 as a bifilar winding, with a centertap 58 connected to a constant positive voltage source 60 which supplies voltage TV. The line 16′ of the decoder 14 is connected to an output 62 of the invertor 52. The output terminal 55 of the invertor 52 is cross connected by a line 54 to an input terminal 66 of the invertor 54.

In operation of the assembly, in the SET mode, as illustrated in FIG. 2, a logic "1" signal S is obtained from the decoder 14 and is applied to the invertor 52 as a positive voltage + V′. The invertor 52 inverts this voltage to a negative voltage −V′ which is applied to the end 51 of the coil 42. The negative voltage −V′ is also applied to the input 66 of the invertor 54 and appears at its output 57 as a positive voltage +V′. The voltage +V′ is applied to the end 53 of the coil 42. By this arrangement the core 40 becomes an N pole and the pole piece 46 becomes an S pole. This causes the magnet bar 24 to be attracted to the pole pieces 44, 46 because the poles of the bar 24 are opposite in polarity to those of the pole pieces 44, 46. At the same time the permanent magnet bar 26 is repelled since its poles are the same as those of the pole pieces 44, 46. The drum 18 is caused to turn and raise a flag 48 to the upright position parallel to the mask 50 as shown in FIGS. 1, 4 and 5. The display unit 10 will remain in this SET position as long as the signal S corresponding to a logic "1" is applied to the invertor 52.

Suppose now it is desired to reset the flag to a retracted position. Referring to FIG. 3, it will be noted that signal S′ corresponding to logic "0" is applied to the invertor 52. This may be a negative voltage −V′. At the output of the invertor 52 and at the input of the invertor 54 will appear a positive voltage +V′. A negative voltage −V′ will appear at the output of the invertor 54. Now the exciting voltages applied to the coil 42 have reversed polarity from those in the SET mode. As a result the pole pieces 44 and 46 assume S and N polarities. This causes a reversal of the magnetic attraction and repulsion conditions which existed in the SET mode and the magnet bar 26 will now be attracted to the pole pieces 44 and 46 and magnet bar 24 will be repelled. The drum 18 will turn counterclockwise from the position of FIG. 1 to the position of FIG. 6. Flag 48 will be turned away from window 49. The assembly will remain in this RESET mode as long as a logic "0" signal pulse S′ is applied to control circuit 12.

From the foregoing description it will be apparent that the flag and rotary drum have only two stable positions, namely, SET and RESET, both maintained by the appropriate logic signal pulse. The decoder will apply appropriate logic signal pulses to all seven control circuits and display units (not shown) everytime a desired character is to be displayed at the mask 50 which is provided with six other windows (not shown) identical to the window 49 and all arranged in conventional rectangular "8" array. Thus when a new character is to be displayed it is not necessary for the decoder to apply a reset pulse to each of the control circuits before applying SET information to selected control circuits as heretofore been necessary.

It should be understood that the foregoing relates to only a preferred embodiment of the invention, and that it is intended to cover all changes and modifications of the example of the invention herein chosen for the purposes of the disclosure, which do not constitute departures from the spirit and scope of the invention.

The invention claimed is:

1. In a character segment display assembly of the type having a rotatable member, carrying a flag for display at a window of a stationary mask said rotating member having a bipolar permanent magnet with an N and an S pole spaced apart and a stationary electromagnetic coil wound on a magnetic core and disposed in fixed position adjacent said rotating member, said core having a pair of spaced magnetizable members defining magnetic poles of opposite polarity whereby electrical energization of said coil will polarize said magnetic poles of said core to attract one of said permanently magnetized poles of said rotatable member; the improvement which comprises:

said coil comprising a bifilar winding having a center tap;

a source of constant positive voltage connected to said center tap;

a first voltage invertor having an output connected to one end of said coil and an input arranged to receive signal voltage pulses; and a second voltage invertor having an output connected to the other end of said coil and an input connected to the output of said first invertor.

2. In a character segment display assembly of the type having a rotatable member as defined in claim 1, further comprising:

a decoder for generating signal voltage pulses corresponding to parts of a character display and having an output connected to the input of said first invertor.

3. In a character segment display assembly of the type having a rotatable member as defined in claim 1, wherein said rotatable member comprises:

a plastic drum and said magnetic poles are disposed in diametrically opposite positions on said drum.

4. In a character segment display assembly of the type having a rotatable member as defined in claim 1, wherein said magnetizable members of said core are plates extending and terminating near opposite ends of said permanent magnetic for magnetically attracting and repelling the same.

5. In a character segment display assembly of the type having a rotatable member as defined in claim 3, further comprising:

a decoder for generating signal voltage pulses corresponding to parts of a character display and having an output connected to the input of said first invertor.

6. In a character segment display assembly of the type having a rotatable member as defined in claim 5, wherein said magnetizable members of said core are plates extending and terminating near opposite ends of said permanent magnetic for magnetically attracting and repelling the same.

7. In a character segment display assembly of the type having a rotatable member as defined in claim 3, further comprising:

a decoder for generating signal voltage pulses corresponding to parts of a character display and having an output connected to the input of said first invertor.

* * * * *